United States Patent [19]

Morrison et al.

[11] 4,275,970

[45] Jun. 30, 1981

[54] PLANT CARE KIT

[75] Inventors: Howard J. Morrison, Deerfield; Douglas P. Montague, Chicago, both of Ill.

[73] Assignee: Dart Industries Inc., Los Angeles, Calif.

[21] Appl. No.: 66,519

[22] Filed: Aug. 15, 1979

[51] Int. Cl.[3] ..... A47L 13/42; A01G 1/00; A47L 13/12; A47L 13/51

[52] U.S. Cl. ..... 401/6; 15/244 A; 15/257.05; 47/1.5; 401/23; 401/48; 401/118; 401/121; 401/123; 401/131

[58] Field of Search ..... 15/104.92, 257.05, 244 R, 15/244 A; 401/6-10, 13, 15, 16-18, 23, 48, 118, 119, 121, 123-126, 130, 131, 191, 196; 47/1.5

[56] References Cited

U.S. PATENT DOCUMENTS

| | | | |
|---|---|---|---|
| 83,088 | 10/1868 | Pearl | 401/125 |
| 958,480 | 5/1910 | Dreher | 401/125 X |
| 1,975,016 | 9/1934 | Nassif | 401/119 |
| 2,163,638 | 6/1939 | Vaughn | 15/257.05 X |
| 2,488,334 | 11/1949 | Schryner | 401/10 |
| 2,841,808 | 7/1958 | Beyland | 401/121 |
| 3,564,636 | 2/1971 | Tomer | 401/10 X |
| 3,893,773 | 7/1975 | Ten Heuw | 401/15 |
| 4,126,962 | 11/1978 | Polcaro | 47/1.5 |

FOREIGN PATENT DOCUMENTS

| | | | |
|---|---|---|---|
| 420217 | 7/1924 | Fed. Rep. of Germany | 15/257.05 |
| 838490 | 4/1952 | Fed. Rep. of Germany | 401/8 |
| 1270455 | 6/1968 | Fed. Rep. of Germany | 15/104.92 |

*Primary Examiner*—Steven A. Bratlie
*Attorney, Agent, or Firm*—Leigh B. Taylor

[57] ABSTRACT

A plant care kit includes a plurality of elements for cleaning and waxing the leaves of household plants. The leaf cleaner includes a support member for gently supporting the leaf of a plant to be cleaned. A soft, porous cleaning element, such as a sponge or the like, is secured to one surface of the support member for engaging the bottom side of a plant leaf. A handle is mounted on the support member, opposite the cleaning member to facilitate grasping by the user and to allow the user of the device to hold the support member in one hand. The leaf cleaning device further includes a second similar cleaning member such as a sponge or the like that may be held in the other hand of the user and placed on top of the leaf to be cleaned. The leaf is sandwiched between the first and second cleaning members and drawn along the length of the leaf thereby simultaneously wiping the upper and lower surfaces. The plant care kit further includes a tray for containing a cleaning fluid such as water or other fluid such as a suitable plant wax. The kit also includes a removable divider which may be placed in the tray to divide the tray into separate chambers. The divider also includes a platform upon which the cleaning members may be mounted to rinse the cleaning members and to allow them to be rinsed and to absorb water or other fluid for further cleaning or waxing.

14 Claims, 6 Drawing Figures

Fig 1
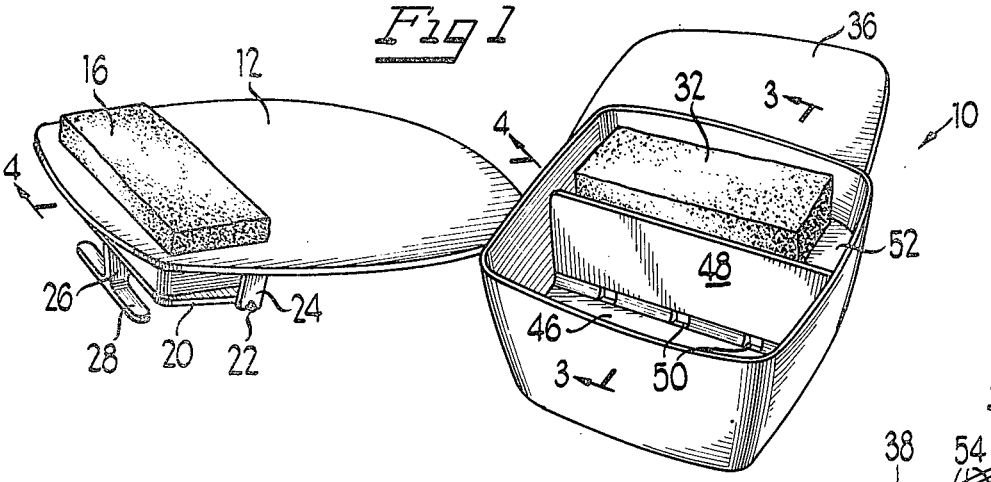
Fig 5
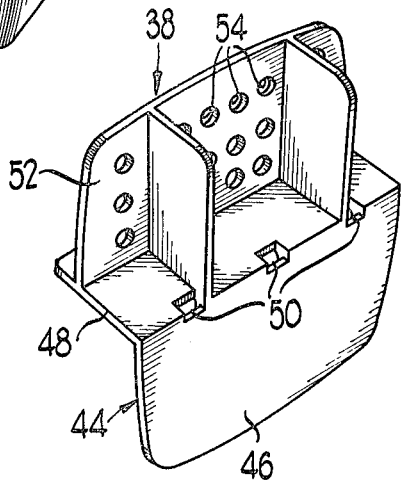
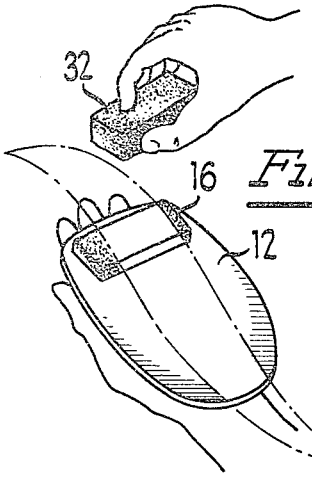
Fig 2
Fig 3
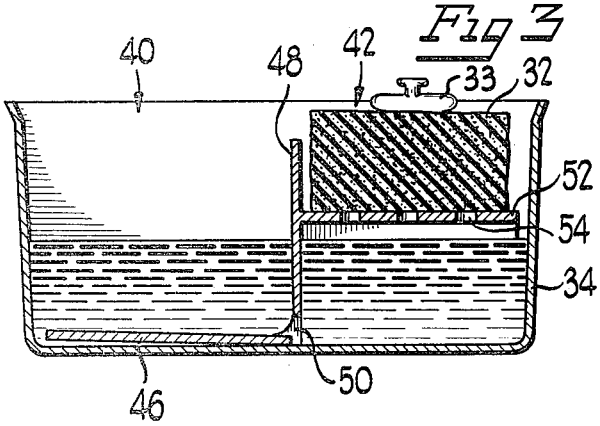
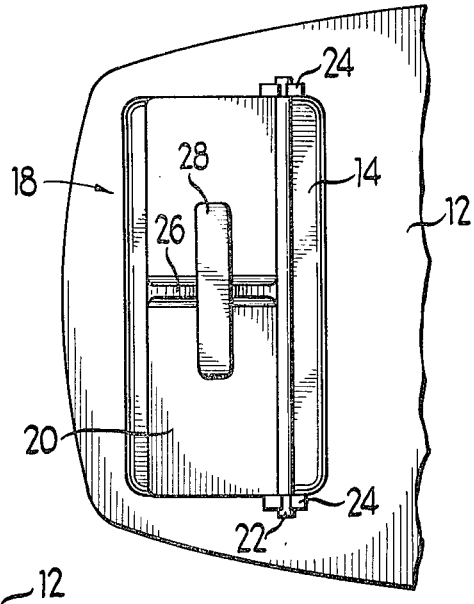
Fig 6
Fig 4
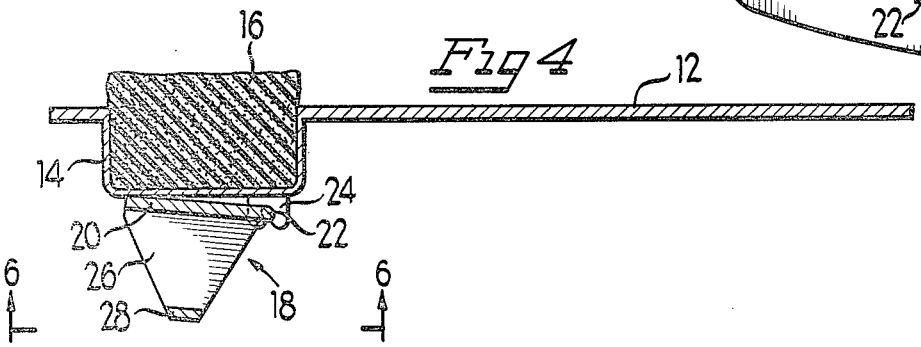

PLANT CARE KIT

BACKGROUND OF THE INVENTION

A. Field of the Invention

The present invention relates to a new and improved plant care kit and in particular to a device for cleaning and waxing leaves of household plants or the like.

B. Description of the Prior Art

Display of plants in homes and commercial areas because of their aesthetic qualities is rapidly becoming popular, resulting in an increased demand for convenient devices for caring for the plants. One important care procedure for plants is washing or cleaning and waxing of the individual leaves of the plants. Typical procedures in the prior art for cleaning the individual leaves is by spray from a hose or a mist bottle. This procedure results in unsatisfactory and incomplete cleaning in that only part of the dirt and debris is washed away.

Another procedure in the prior art is wiping the leaf with a damp or dry cloth. This procedure also has disadvantages such as for example, the availability of the cleaning cloth and the distance of the plants from a source of cleaning water and the harshness of the rag on certain leaves of plants that could result in damage

SUMMARY OF THE INVENTION

An object of the present invention is to provide a new and improved device for the care of house plants and the like.

Another object of the present invention is to provide a new and improved hand held device for cleaning leaves of plants and the like that can be easily cleaned.

A further object of the present invention is to provide a new and improved device for cleaning leaves of plants that includes a hand held cleaning member and a tray containing the cleaning fluids so as to allow for rinsing the cleaning member and waxing of the top of the leaf.

The present invention is directed to a new and improved plant care kit including a device for cleaning the leaves of house plants and the like having a support member for gently supporting a leaf to be cleaned. The support member includes on one surface a cleaning member such as a sponge which may be removed to be cleaned and reattached to the support member. On the opposite side of the support member is a handle for grasping by the hand of the user to allow easy use and control of the support member.

The cleaning device further includes a second cleaning member such as a sponge to be placed on top of the leaf with the support member beneath the leaf. Thereafter with the leaf captured between the two cleaning members, the leaf may be wiped with a movement of the hands of the operator pulling the device along the length of the leaf.

The plant care kit further includes a tray for containing water for rinsing the two sponges or wax for later applications. The tray includes a divider dividing the tray into compartments and a shelf on which the one sponge may be stored while not in use.

BRIEF DESCRIPTION OF THE DRAWING

The above and other objects and advantages and novel features of the present invention will become apparent from the following detailed description of the preferred embodiment of the invention illustrated in the accompanying drawing wherein:

FIG. 1 is a perspective view of the plant care kit constructed in accordance with the principles of the present invention;

FIG. 2 is a view illustrating the use of the leaf cleaning device of the present invention;

FIG. 3 is a view taken generally along line 3—3 of FIG. 1;

FIG. 4 is a view taken generally along line 4—4 of FIG. 1;

FIG. 5 is an enlarged perspective view of a partition used in the leaf cleaning device of the present invention; and FIG. 6 is a fragmented view taken generally along line 6-6 of FIG. 4.

DESCRIPTION OF THE PREFERRED EMBODIMENT

Referring to the drawing and initially to FIG. 1, there is illustrated a plant care kit generally designated by the reference numeral 10. The plant care kit is portable and may be used to clean the leaves of common house plants or the like without damaging the leaves. The cleaning members for cleaning the leave and a supply of cleaning fluid is self-contained in the device 10 and may be carried by the plant owner from plant to plant.

More specifically, the device 10 includes lightweight, rigid support member 12 that may be of any desired shape but preferably substantially planar. An integral container 14 is provided at one end of the support member 12 within which is positioned a plant leaf cleaning member 16 such as a sponge or other soft porous element. The sponge 16 is positionable within the container 14 and may be easily removed to be cleaned or replenished with cleaning fluid such as water. In an alternative form, the sponge 16 may extend along the entire length of the support member 12 to gently support the entire length of the leaf. A handle generally designated by the reference numeral 18 is located on the bottom surface of the support member 12. The handle 18 is intended to fit between the fingers of the plant owner so as to facilitate gripping of the support member 12. The handle 18 includes a flat portion 20 that includes an integral pin 22 pivotally mounted in a pair of depending clips 24 integrally defined on the bottom surface of the support member 12. Extending downwardly from the flat portion 20 is a spacer bar 26 on which is integrally defined a transverse capturing member 28. As seen in FIG. 2, the bar 26 may be slid between two fingers of one hand of the user of the plant kit with the fingers captured between the flat portion 20 and the transverse member 28. The remaining portion of the support member 12 may extend along the palm and wrist of the user as illustrated in FIG. 2, providing a flat surface upon which a leaf 30 of a plant may be gently but securely supported.

The device 10 also includes a second cleaning member or sponge 32 which in the preferred embodiment illustrated may be grasped by a hand of the plant owner as illustrated in FIG. 2. In an alternative embodiment, a handle 33 may be mounted on one side of the sponge 32 to facilitate gripping by the user and to prevent cleaning fluid or wax from soiling the hands of the user.

To clean a leaf 30, the user of the plant kit grasps the support member 12 in the fashion illustrated in FIG. 2 and places the leaf on top of the first sponge 16. The user then grasps the second sponge 32 and sandwiches the leaf 30 between the sponges 16 and 32. Thereafter, the support member 12 and the sponge 32 may be simultaneously pulled along the length of the leaf 30 to clean the upper and lower surfaces of the leaf 30 simultaneously. Alternating, only the top of the leaf may be cleaned by holding the support member stationary. Also, this method should be used if a wax is applied to avoid clogging the pores on the bottom of the leaves.

To provide a supply of cleaning fluid such as water for purposes of cleaning the leaves and rinsing the sponges 16 and 32, the device 10 includes a separate portable tray 34. The tray 34 includes a top cover portion 36 and a partition generally designated by the reference numeral 38 that may be removably positioned within the tray 34 (FIG. 3) to divide or partition the tray 34 into two chambers 40 and 42. The divider 38 includes and L-shaped portion 44 including a horizontal portion 46 and a vertical portion 48 that when positioned in the tray (FIG. 3), divides the tray 34 into the two compartments 40 and 42. A plurality of apertures 50 are defined at the intersection between the horizontal portion 46 and the vertical portion 48 of the divider 38 to allow the flow of water between the chambers 40 and 42.

The divider 38 also includes an integral shelf member 52 with a plurality of apertures 54. The shelf member 52 is intended to support either of the sponges 16 or 32 at a location above the water line in the tray 34 to allow the water to drain out of the sponges 16 or 32. To replenish the water in either of the sponges 16 or 32 and to continue cleaning leaves 30 and to rinse the sponges 16 and 32 clean, either sponge 16 or 32 may be placed in the chamber 40 and rinsed in the water contained therein. Thereafter, either of the sponges 16 or 32 may be placed on the shelf 52 to allow drying as the water drains from the sponges 16 and 32 and passes through the apertures 54 into the chamber 40. In an alternative form, the cavity 14 may be enlarged to extend through the length of support member 12 to provide a water supply in the support member itself.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A plant care kit, comprising:

a generally planar support means for gently supporting a leaf of a plant or the like;

a first cleaning element mounted on the top surface of said support means for engaging the underside of the leaf;

a handle mounted on the bottom surface of said support means for limited oscillation about an axis generally parallel to the bottom surface;

said handle including means for captured interdigitated engagement of the fingers of a user;

a manually operable second cleaning element for engaging the top of said leaf; and reservoir means for containing a predetermined amount of cleaning fluid to be applied to the leaves by said cleaning elements.

2. The plant care kit of claim 1 wherein said support means comprises a generally resilient planar member.

3. The plant care kit of claim 1 wherein said first cleaning element is removably mounted on said support means.

4. The plant care kit of claim 1 or 3 wherein said first cleaning element comprises a sponge mounted on said support means.

5. The plant care kit of claim 1 wherein said second cleaning element comprises a sponge.

6. The plant care kit of claim 5 wherein said second cleaning element includes handle means secured thereto to facilitate manual grasping thereof by the user.

7. The plant care kit of claim 1 or 6 wherein said reservoir means comprises an open top tray and a cover therefor.

8. The plant care kit of claim 7 further including dividing means for dividing said tray into a plurality of compartments, said dividing means including a shelf for supporting either of said first and second cleaning elements in said tray.

9. An apparatus for cleaning the leaves of a plant or the like, comprising:

a generally planar hand-held support member for gently supporting the underside of a leaf to be cleaned;

a first absorbent cleaning element removably mounted on one side of said support member;

a handle mounted on the opposite side of said support member for limited oscillation about an axis generally parallel to the plane of said support member to facilitate manual interdigitated grasping by the user;

a second manually manipulatable, absorbent cleaning element for engaging the top of a leaf; and a reservoir means comprising an open top tray for containing a predetermined amount of a suitable fluid to be applied by said cleaning elements to the surfaces of the leaf to be cleaned.

10. The apparatus of claim 9 including a cover for closing the top of the reservoir to prevent evaporation of fluid therein.

11. The apparatus of claim 9 or 10 further comprising a partition means removably mounted in said tray for defining two chambers therein.

12. The apparatus of claim 11 wherein said partition includes a shelf portion for supporting said second cleaning element.

13. The apparatus of claim 9 including a cavity in said support member for removably mounting the first cleaning element therein.

14. The apparatus of claim 13 wherein said handle is mounted on the underside of said cavity.

* * * * *